US009389014B2

(12) United States Patent
Rehage et al.

(10) Patent No.: US 9,389,014 B2
(45) Date of Patent: Jul. 12, 2016

(54) FITTING

(71) Applicant: PAUL HETTICH GMBH & CO. KG, Kirchlengern (DE)

(72) Inventors: Daniel Rehage, Bielefeld (DE); Thorsten Kloth, Hiddenhausen (DE)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 21 days.

(21) Appl. No.: 14/347,429

(22) PCT Filed: Sep. 18, 2012

(86) PCT No.: PCT/EP2012/068327

§ 371 (c)(1),
(2) Date: Mar. 26, 2014

(87) PCT Pub. No.: WO2013/045312

PCT Pub. Date: Apr. 4, 2013

(65) Prior Publication Data

US 2014/0239789 A1 Aug. 28, 2014

(30) Foreign Application Priority Data

Sep. 27, 2011 (DE) ..... 10 2011 053 985

(51) Int. Cl.

| | |
|---|---|
| ***F25D 25/02*** | (2006.01) |
| ***A47B 88/02*** | (2006.01) |
| *A47B 88/00* | (2006.01) |

(52) U.S. Cl.

CPC ..... *F25D 25/025* (2013.01); *A47B 88/02* (2013.01); *A47B 2088/0081* (2013.01); *A47B 2088/026* (2013.01)

(58) Field of Classification Search

CPC F25D 25/025; A47B 88/02; A47B 2088/026; A47B 2088/0081; A47L 15/506; F24C 15/162

USPC ..... 312/402, 334.1, 310, 325, 295

See application file for complete search history.

(56) References Cited

U.S. PATENT DOCUMENTS 2,486,564 A * 11/1949 Kamin ..... 126/41 E
2,525,201 A * 10/1950 Beynon et al. ..... 126/340

(Continued)

FOREIGN PATENT DOCUMENTS

DE 202006012565 U 10/2006
DE 202006012656 1/2007

(Continued)

OTHER PUBLICATIONS

International Preliminary Report on Patentability issued in Int'l Patent Application No. PCT/EP2012/068327 dated Apr. 1, 2014.

(Continued)

*Primary Examiner* — Daniel J Troy
*Assistant Examiner* — Ryan A Doyle
(74) *Attorney, Agent, or Firm* — Barnes & Thornburg LLP

(57) ABSTRACT

A fitting, in particular for a piece of furniture or a domestic appliance, comprises a first storage element, which is mounted such that it can be displaced from a rear storage position into an access position, and a second storage element, which is coupled to the first storage element via at least one connecting element, wherein the second storage element is mounted in a pivotable manner and can be raised, via the first storage element, from a lowered, storage position into an access position. This makes it possible for the stowage space in a domestic appliance to be optimally utilized.

17 Claims, 7 Drawing Sheets

(56) References Cited

U.S. PATENT DOCUMENTS

| | | | | |
|---|---|---|---|---|
| 2,590,341 | A | 3/1952 | Nabholz | |
| 2,926,507 | A * | 3/1960 | Ingolia | 62/377 |
| 2,975,012 | A * | 3/1961 | Thull | 312/274 |
| 3,195,969 | A * | 7/1965 | Wallen | 312/269 |
| 3,376,087 | A * | 4/1968 | Hardy | 312/269 |
| 3,390,930 | A * | 7/1968 | Peterson | 312/269 |
| 7,232,196 | B2 * | 6/2007 | Kwon et al. | 312/402 |
| 7,396,093 | B2 * | 7/2008 | Jeong et al. | 312/402 |
| 7,488,048 | B2 * | 2/2009 | Paganini | 312/249.11 |
| 7,527,343 | B2 * | 5/2009 | Oh et al. | 312/402 |
| 7,628,461 | B2 | 12/2009 | Carden et al. | |
| 7,794,027 | B2 * | 9/2010 | Calabria et al. | 312/311 |
| 8,231,190 | B2 * | 7/2012 | Ertz et al. | 312/402 |
| 2007/0018545 | A1 | 1/2007 | Calabria et al. | |
| 2010/0175440 | A1 | 7/2010 | Zinn | |

FOREIGN PATENT DOCUMENTS

| | | |
|---|---|---|
| EP | 1881282 | 1/2008 |
| GB | 516744 | 1/1940 |
| WO | WO 03/017806 | 3/2003 |
| WO | WO 2006/125630 | 11/2006 |
| WO | WO 2007/022757 | 3/2007 |

OTHER PUBLICATIONS

Office Action issued in Chinese Patent Application No. 201280047029.4.

Search Report issued in German App. No. 102011053985.9 (2012).

Search Report issued in Int'l App. No. PCT/EP2012/068327 (2012).

* cited by examiner

FITTING

CROSS REFERENCE TO RELATED APPLICATIONS

This application is a U.S. nationalization under 35 U.S.C. §371 of International Application No. PCT/EP2012/068327, filed Sep. 18, 2012, which claims priority to German Patent Application No. 102011053985.9, filed Sep. 27, 2011. The disclosures set forth in the referenced applications are incorporated herein by reference in their entireties.

The present disclosure relates to a fitting, especially for a piece of furniture or a domestic appliance, comprising a first storage element, which is mounted such that it can be displaced from a rear storage position to an access position, and a second storage element, which is coupled to the first storage element via at least one connecting element.

WO 2006/125630 discloses a fitting, in which a first drawer is provided on opposite side frames with a pull-out guide, on which a second upper drawer is movably mounted. As a result, the upper second drawer is guided on the first drawer and the storage space can be utilized in a better way. Especially when the upper drawer has a large height, access to the bottom drawer is rendered more difficult, so that this configuration of the fitting is not suitable for such applications.

The present disclosure illustrates and describes an illustrative fitting which enables improved utilization of the storage space and further offers simple handling.

In an illustrative embodiment, the fitting comprises a first storage element and a second storage element, wherein the second storage element is pivotably mounted and can be moved by the first storage element from a lower storage position to an axis position. As a result, the second storage element situated at a lower level can be lifted via a movement of the first storage element, which simplifies access and therefore also enables the utilization of a storage space beneath the first storage element.

Preferably, the second storage element is arranged in the lower storage position at least partly beneath the first storage element. The first storage element can be moved from a rear access position to a front access position for lifting and pivoting the second storage element, so that a second storage element is then lifted by the coupling with the connecting element. The user merely needs to grip and move the first storage element in order to move both the first and also the second storage element.

For the purpose of ensuring a smooth movement of the first storage element, it can be displaceably mounted on at least one pull-out guide. Pull-out guides are preferably arranged on opposite sides of the first storage element.

The required pull-out length is obtained from the addition of the lengths of the used storage elements. Preferably, a considerable excess pull-out of up to 200 percent is used. It can be achieved by a combination of at least two pull-out guides consisting of three respective rails or by a multi-member pull-out guide. In the case of a combination of two pull-out guides, the guide rail of the second plug guide is connected to the running rail of the first pull-out guide.

At least one lever can be provided for a mechanically simple coupling of the second storage element to the first storage element. At least two levers are preferably provided as connecting elements, which are connected to each other in an articulated manner.

In accordance with a further embodiment, the second storage element is arranged in the lifted position substantially on a plane with the first storage element. The access to the second storage element can thus be achieved, especially when the first and/or the second storage element is arranged as a box or as a container.

Two support levers are preferably provided for stable mounting, which guide the second storage element in the manner of a parallelogram guide. This allows a substantially horizontal alignment of a base of the second storage element even during a pivoting movement.

In order to prevent an impact of the second storage element during the lowering to the storage position, a damper is preferably provided in order to brake the second storage element before reaching the lower storage position. Furthermore, a damper can also be provided on the pull-out guide for braking the closing motion of the first storage element. Furthermore, rotational dampers can also be used in the bearing points.

The opening process of the second storage element can also occur in a spring-supported manner. As a result, the user can be supported during opening when the second storage element is heavily loaded.

The coordination of the first and second storage element with respect to each other occurs via a coupler gear.

In an illustrative embodiment, a domestic appliance with a respective fitting is provided, wherein the domestic appliance may be a refrigerator.

The invention will be explained in greater detail below by reference to an embodiment shown in the drawings, wherein.

Figure 1:
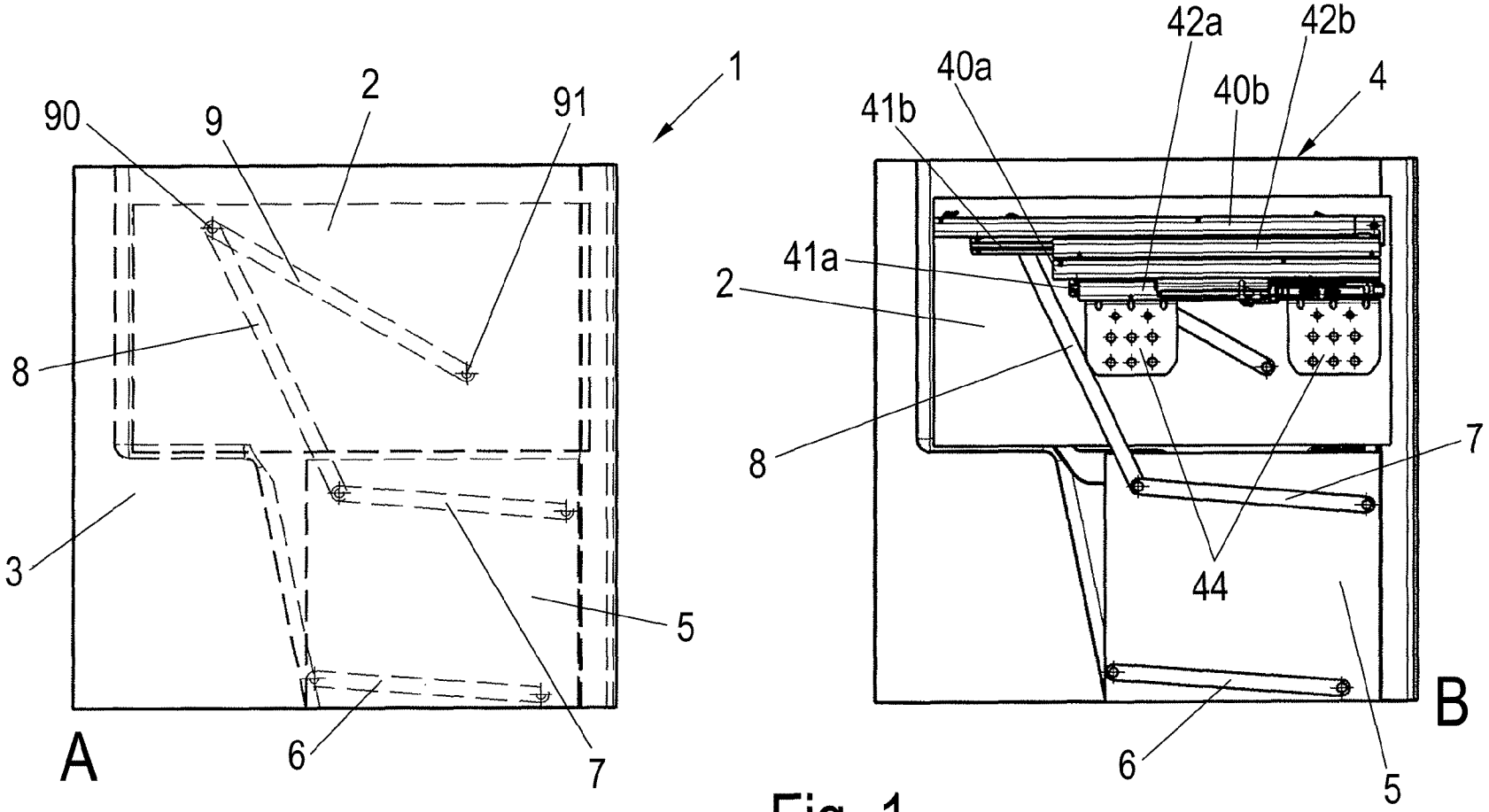
FIGS. 1A to 1D show several views of a fitting in the storage position.
Figure 1:
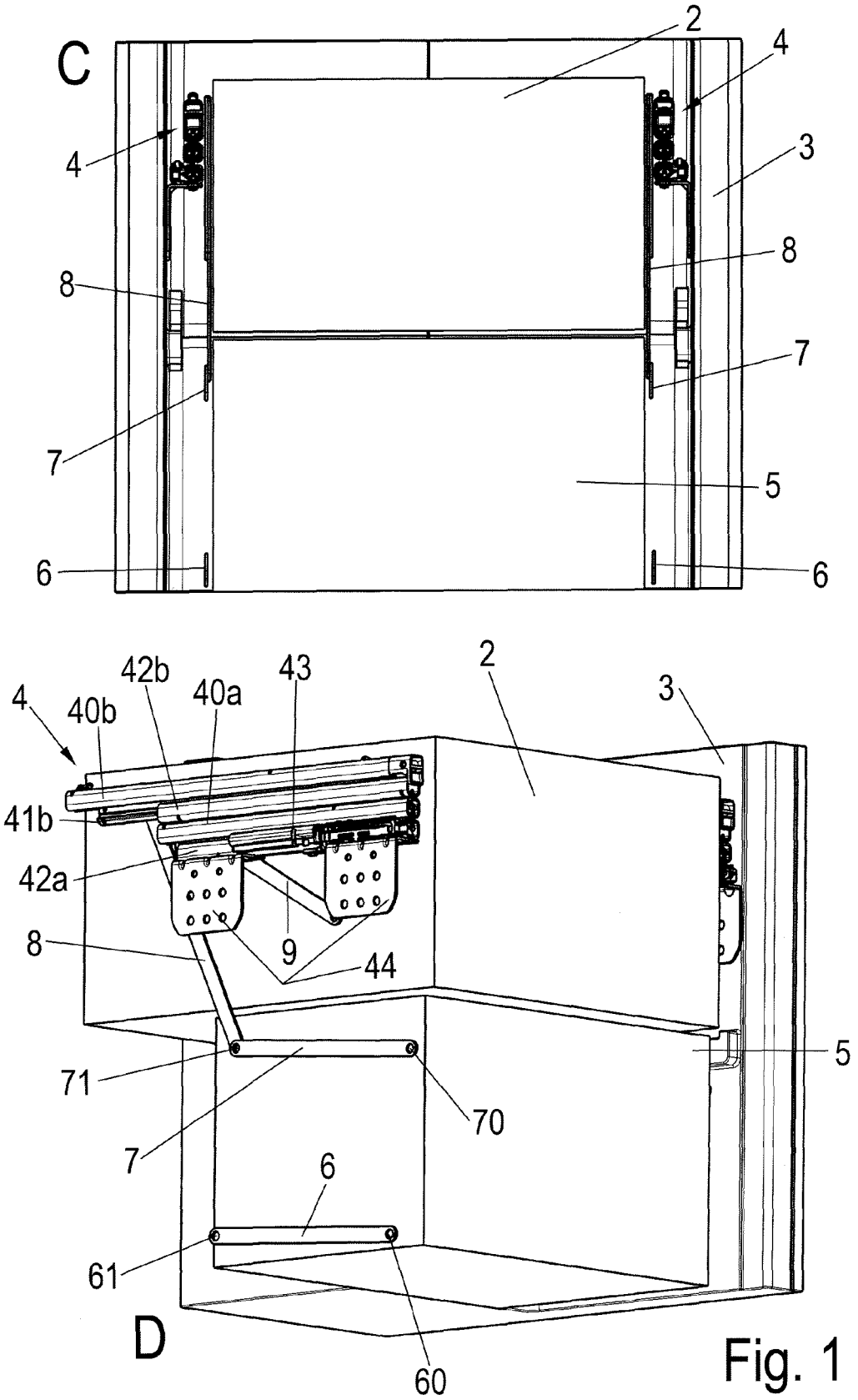

FIGS. 1A to 1D show a part of the domestic appliance 1, especially a refrigerator, in which a fitting in accordance with the invention is built into a furniture body 3. A first upper storage element 2 is provided in the furniture body 3, which upper storage element is arranged in the manner of a box and is displaceably mounted on opposite sides by one respective pull-out guide 4. The pull-out guide 4 is composed of a first pull-out guide comprising the rails 40*a*, 41*a* and 42*a* and a second pull-out guide comprising the rails 40*b*, 41*b* and 42*b*. The rail 40*a* is rigidly connected as a running rail to a rail 42*b* as the guide rail of the second pull-out guide, so that the rails 40*a* and 42*a* are displaced simultaneously. The rails 41*a* and 41*b* are arranged as middle rails between the rails 40*a* and 42*a* as well as 40*b* and 42*b*. It is also possible to use pull-out guides in other configurations.

In the storage position, a second storage element 5 is situated beneath the first storage element 2, which second storage element is also arranged in the manner of a box and is pivotably held on the furniture body 3 via two support levers 6 and 7. The support lever 6 comprises a bearing point 60 which is fixed to the furniture body 3 and a bearing point 61 which is fixed to the second storage element 5. The upper support lever 7 also comprises a bearing point 70 on the furniture body 3 and a bearing point 71 on the second storage element 5. This leads to a guidance of the storage element 5 in the manner of a parallelogram when it is pivoted with the support lever 6 and 7.

The first storage element 2 and the second storage element 5 are coupled to each other via a connecting element, which comprises a first lever 8 that is connected in an articulated manner to a second lever 9. The lever 9 is connected at the end side in an articulated manner via a bearing point 91 to the first storage element 2 and at the opposite end via a bearing point 90 to the lever 8. The lever 8 is rotatably held on the second storage element 5 via the bearing point 71 on the side opposite of the bearing point 90.

Figure 2A:
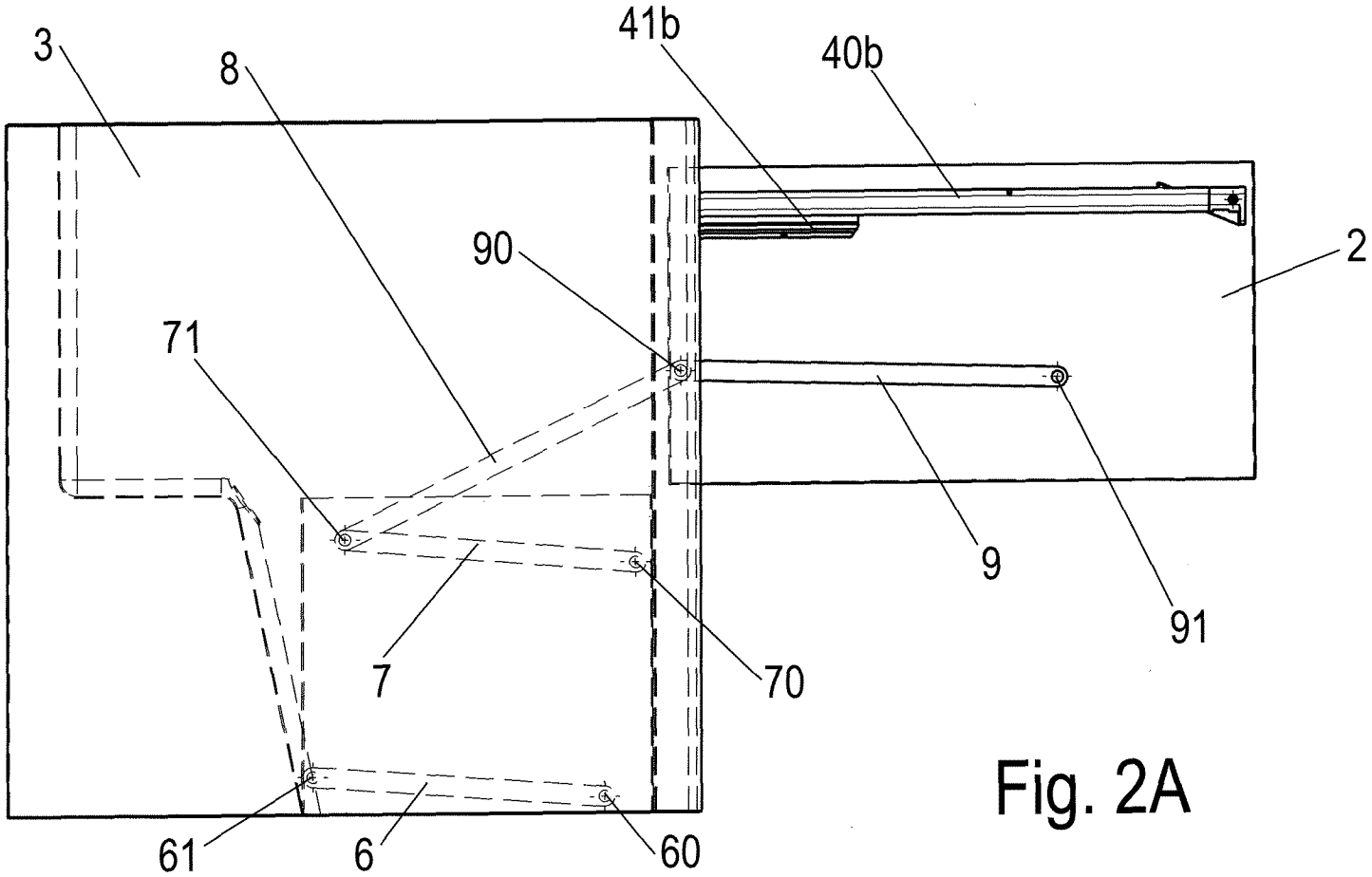
FIGS. 2A to 2B show two views of the fitting of FIG. 1 with the first storage element in a rear access position.
Figure 2B:
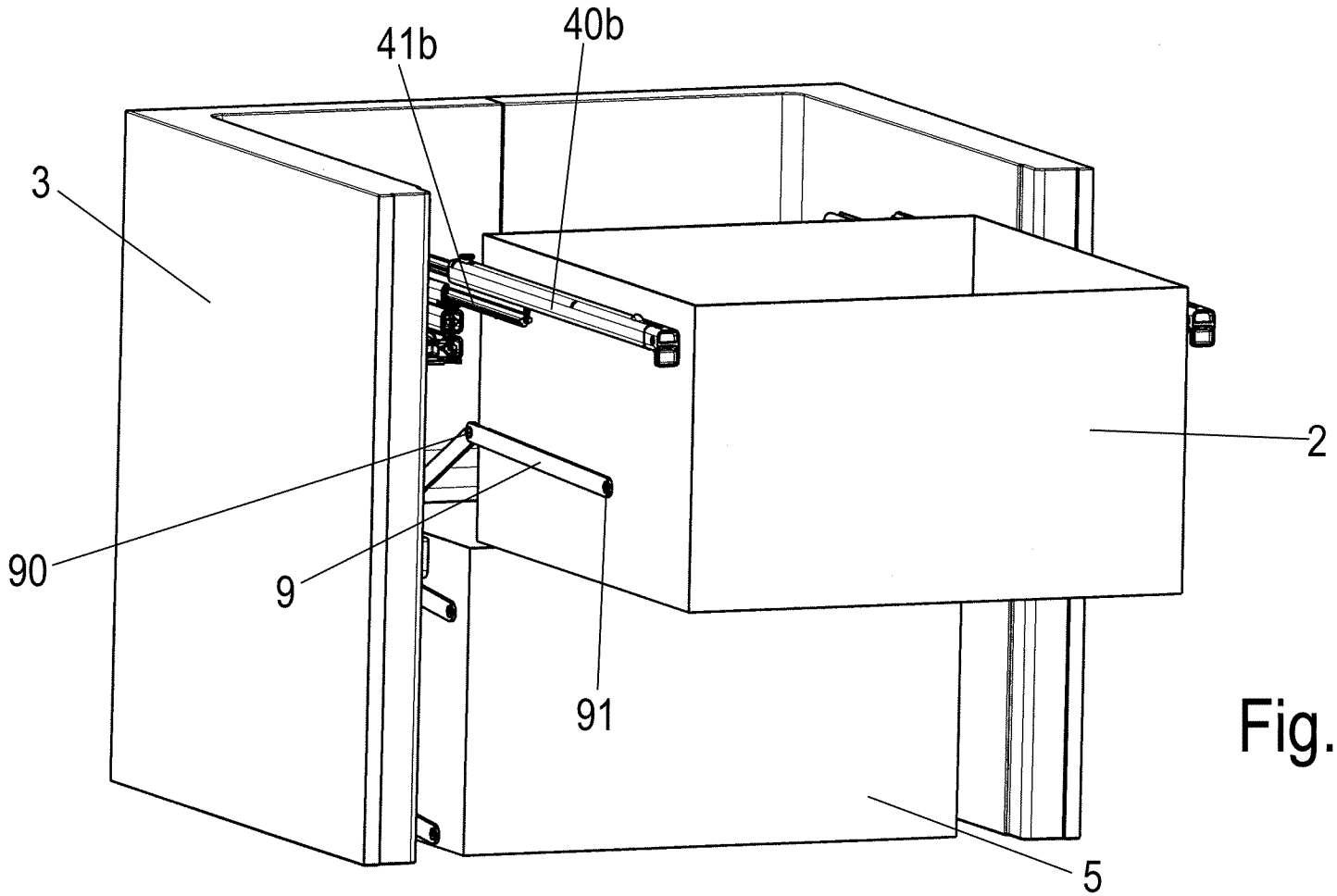

The pull-out guide 4 comprises a guide rail 42*a* which is fixed by means of mounting elements 44 to the furniture body 3, a middle rail 41*a*, a running rail 40*a*, a guide rail 42*b*, a middle rail 41*b* and a running rail 40*b* on which the storage element 2 is held. As a result, the first storage element 2 can be moved smoothly from a storage position to a rear access position, which is shown in FIGS. 2A and 2B. A damper 43 is arranged on the guide rail 42*a*. In this rear access position, the first storage element 2 is situated before the furniture body 3 and the second storage element 5 is still situated in the lowered storage position in the furniture body 3. The displacement of the first storage element 2 results in levers 8 and 9 being pivoted to a substantially extended position.

Figure 3A:
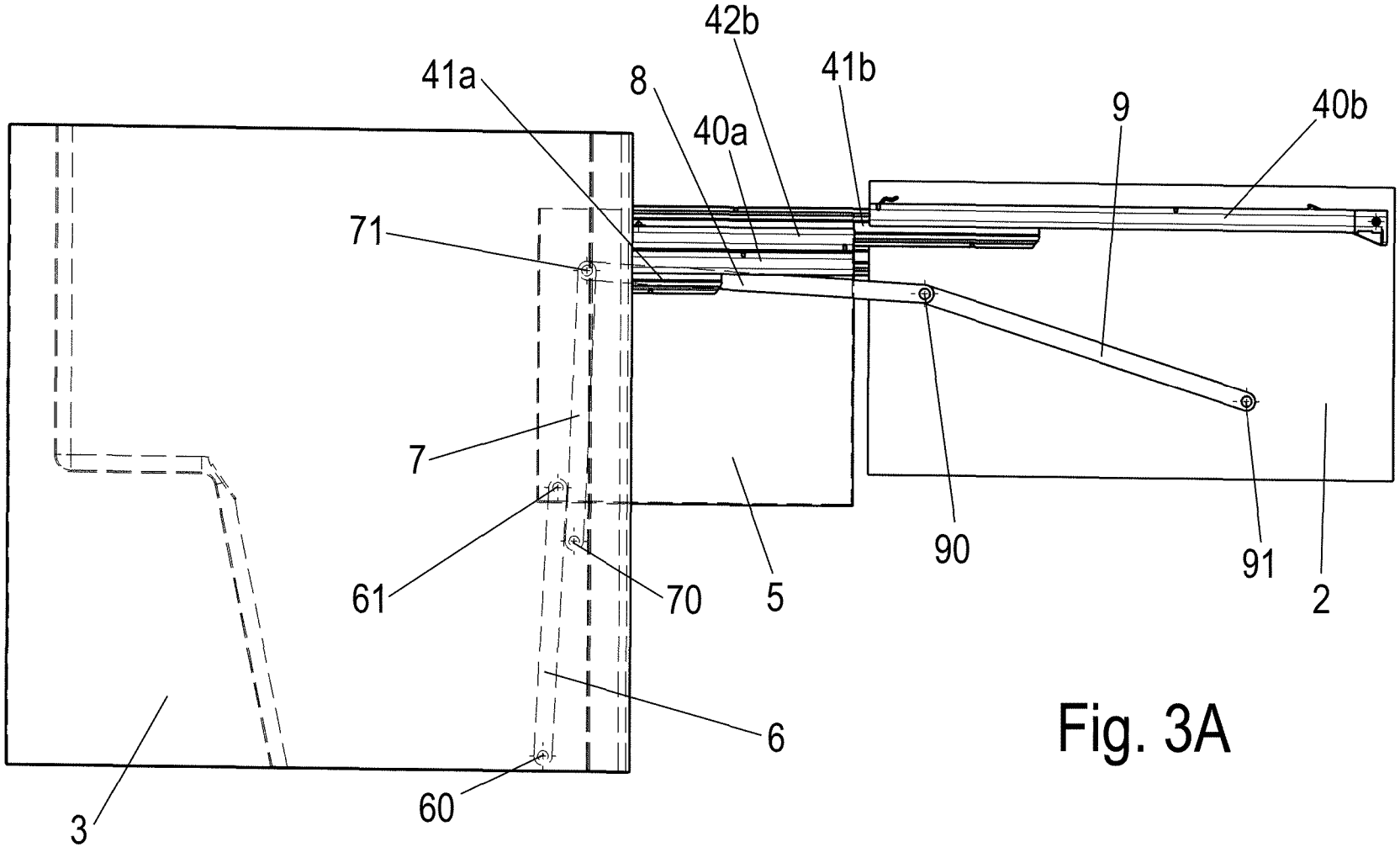
FIGS. 3A to 3C show several views of the fitting of FIG. 1 in a lifted position of the second storage element.
Figure 3B:
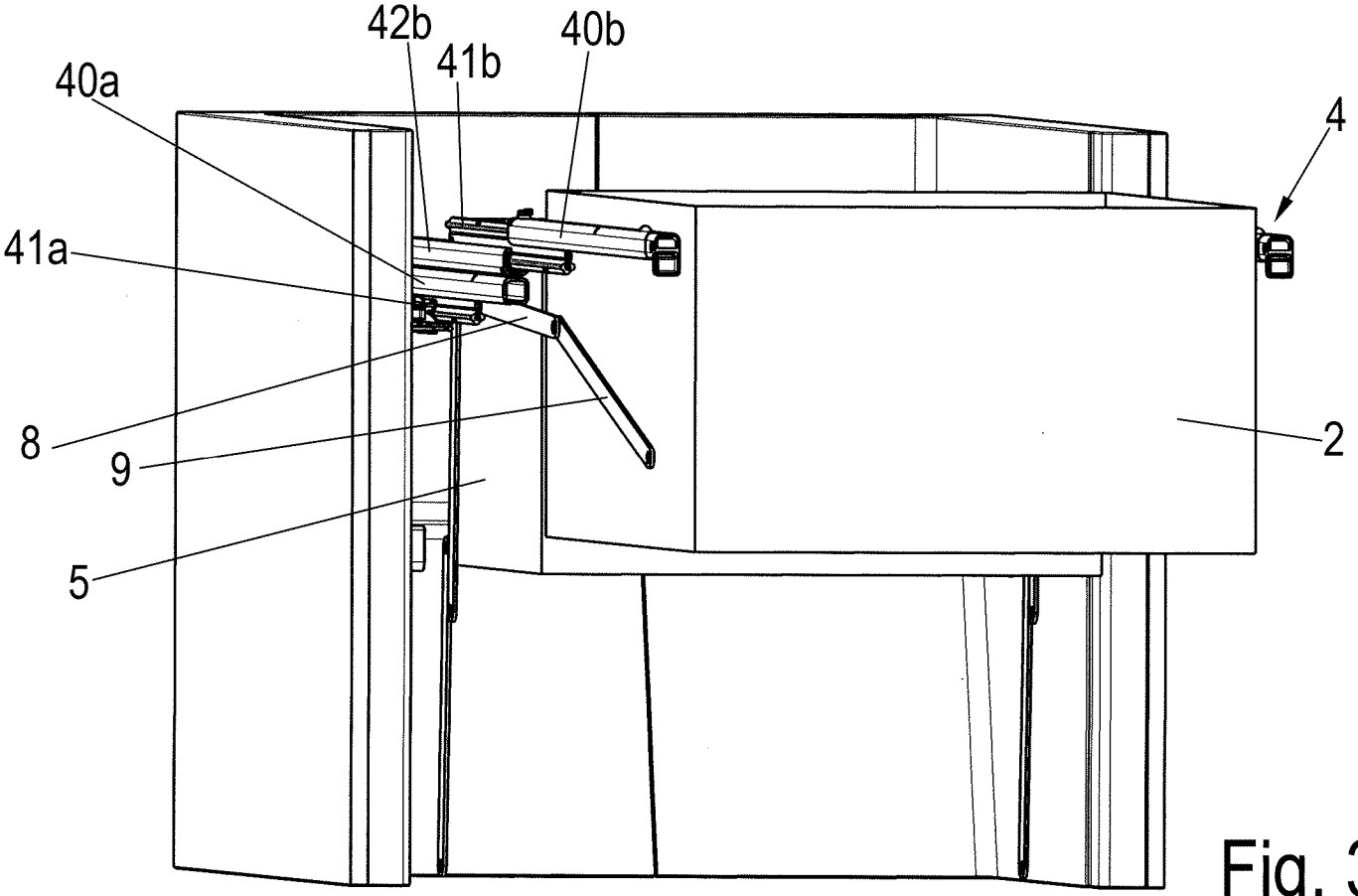
Figure 3C:
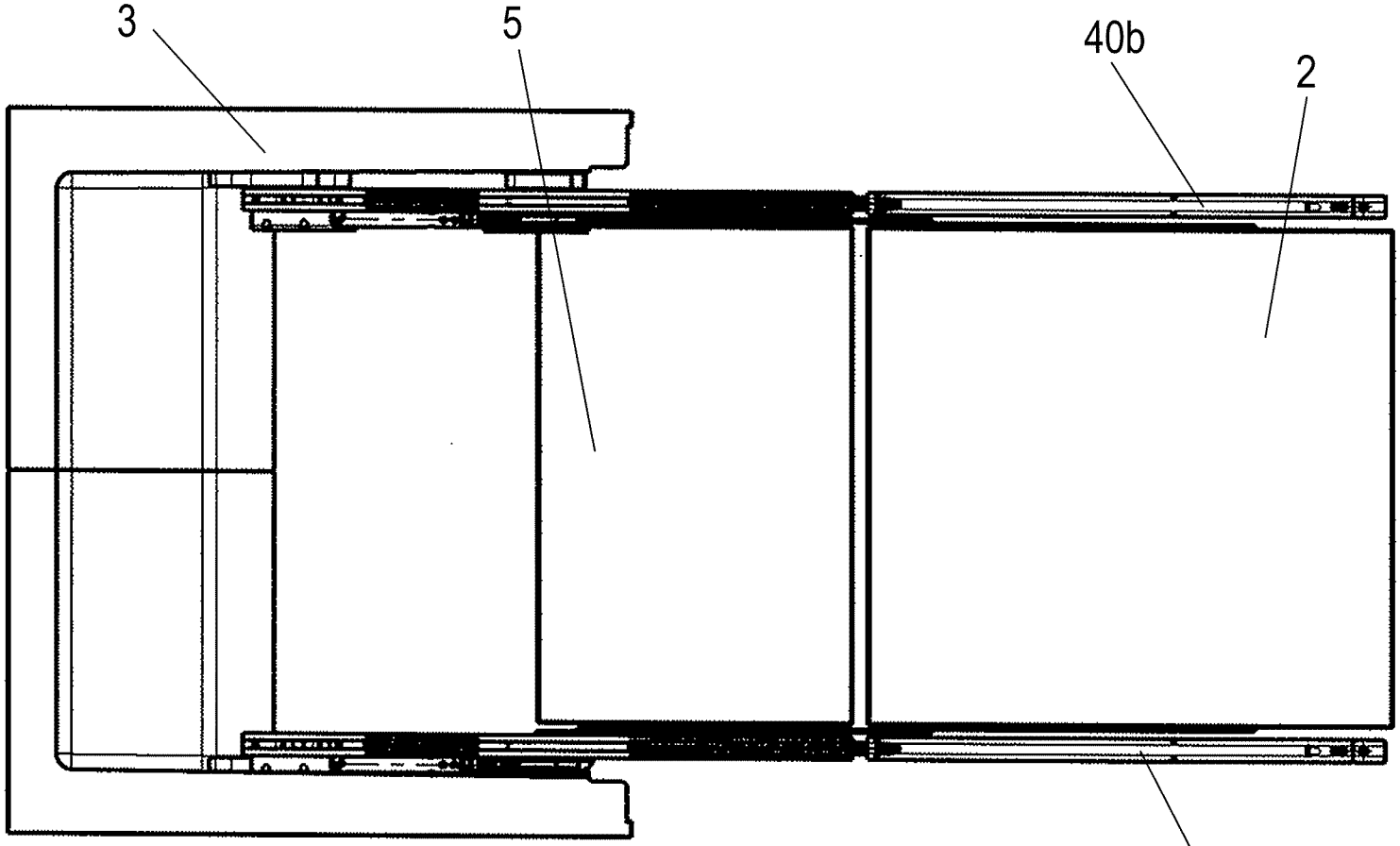

In order to lift the second storage element 5 from the lowered storage position to an access position, the first storage element 2 can be displaced from a rear access position to a front access position which is shown in FIGS. 3A to 3C. By pulling the first storage element 2 in the opening direction, the second storage element 5 is pivoted upwardly via the two levers 8 and 9, wherein the path of the pivot is defined by the support levers 6 and 7 which are arranged in the manner of a parallelogram. The base of the second storage element 5 remains in a substantially horizontally aligned position. When the second storage element 5 is arranged in a lifted access position, the two support levers 6 and 7 are pivoted slightly beyond an upper dead centre position (best shown in FIG. 3A, wherein levers 6 and 7 are slightly off-vertical), so that the second storage element 5 remains in a stable manner in the lifted access position and does not need to be held. The pivoting motion of the support levers 6 and 7 can be limited by a respective limit stop.

For the movement of the first storage element 2 and the second storage element 5 back to the storage position, the first storage element 2 is pushed in the direction of the furniture body 3 again, so that the second storage element 5 pivots back to a lowered position by guidance of the support levers 6 and 7. A damper can be provided shortly before reaching the lowered position, which damper decelerates the movement of the second storage element 5 and prevents strong impact. The first storage element 2 can then be pushed completely into the furniture body 3 again until it has reached the position shown in FIGS. 1A to 1D.

The fitting in accordance with the invention is preferably mounted on opposite sides on the furniture body 3 in order to ensure stable guidance. The fitting is especially suitable for use in domestic appliances such as refrigerators, but can also be used in items of furniture or other objects.

A connecting element with the levers 8 and 9 is provided in the illustrated embodiment for connection. It is obviously also possible to use more than two levers as a connecting element, e.g. a lever joint chain with three levers or a lever joint chain with four or more levers. As a result, the connecting element can be provided with an even more compact configuration and less overall space is required. The lever 8 can be replaced for example by two or three levers. The levers can be guided to the desired sequence of movements by limit stop or spring systems. The use of more than two levers 8 and 9 leads to the further advantage that the actuation force of the pull-out can be reduced initially.

Furthermore, the bearing points can also be changed in the position, e.g. in order to achieve a more stable end position of the second storage element 5. Furthermore, the two bearing points can be stabilized by means of a guide plate in which the path of movement is reflected.

The invention claimed is:

1. A domestic appliance comprising a furniture body and a fitting built into the furniture body, the fitting comprising:

a pull-out guide mounted to the furniture body;

a first storage element, the first storage element mounted to the pull-out guide and displaceable in a first direction between a rear storage position wherein the first storage element is disposed within the furniture body, a rear access position in which at least a portion of the first storage element is disposed outside the furniture body, and a front access position, the rear access position being between the rear storage position and the front access position; and a second storage element, the second storage element connected to the first storage element via a connecting element, the second storage element further pivotally coupled to the furniture body via at least two support levers, each of the at least two support levers pivotally connected to the second storage element and to the furniture body, wherein the second storage element is displaceable between a lowered storage position at least partly beneath the first storage element and a lifted access position, and wherein displacement of the first storage element from the rear access position to the front access position results in displacement of the second storage element from the lowered storage position to the lifted access position.

2. A domestic appliance according to claim 1, wherein the second storage element is arranged in the lifted access position substantially level with the first storage element.

3. A domestic appliance according to claim 1, wherein either or both of the first and second storage elements is arranged as a box or a container.

4. A domestic appliance according to claim 1, wherein the connecting element comprises at least two levers which are connected to each other in an articulated manner.

5. A domestic appliance according to claim 4 wherein a first lever of the at least two levers is pivotally connected to the first storage element and a second lever of the at least two levers is pivotally connected to the second storage element.

6. A domestic appliance according to claim 1, further comprising a damper configured to decelerate the second storage element before reaching the lowered storage position when moved from the lifted access position to the lowered storage position.

7. A domestic appliance according to claim 1 wherein at least a portion of the second storage element, when the second storage element is in the lifted access position, extends from the furniture body in the first direction.

8. A domestic appliance according to claim 1 wherein at least a portion of the second storage element, when the second storage element is in the lifted access position, is located between the furniture body and the first storage element.

9. A domestic appliance according to claim 1 wherein the at least two support levers are substantially perpendicular to a direction of displacement of the first storage element when the second storage element is in the lifted access position and wherein the at least two support levers are substantially parallel to the direction of displacement of the first storage element when the second storage element is in the lowered storage position.

10. A domestic appliance according to claim 1 further comprising a second pull-out guide mounted to the furniture body, the first storage element further mounted to the second pull-out guide.

11. A domestic appliance according to claim 10 wherein the first and second pull-out guides are mounted to opposite sides of the furniture body and to opposite sides of the first storage element.

12. A domestic appliance according to claim 10 wherein each of the first pull-out guide and the second pull-out guide comprises three rails.

13. A domestic appliance according to claim 1 wherein the first pull-out guide comprises three rails.

14. A domestic appliance according to claim 1 wherein a first support lever of the at least two support levers is connected to the furniture body at a first pivot point and to the second storage element at a second pivot point, wherein a second support lever of the at least two support levers is connected to the furniture body at a third pivot point and to the second storage element at a fourth pivot point, and wherein first and second support levers of the at least two support levers remain parallel as the second storage element is displaced between the lowered storage position and the lifted access position.

15. A domestic appliance according to claim 14 wherein the second pivot point is on a first side of a vertical plane extending through an axis of rotation of the first pivot point when the second storage element is in the lowered storage position and wherein the second pivot point is on a second side of the vertical plane extending through the axis of rotation of the first pivot point when the second storage element is in the lifted access position.

16. A domestic appliance according to claim 15 wherein the second pivot point is substantially above the first pivot point when the second storage element is in the lifted access position.

17. A domestic appliance according to claim 15 further comprising means for limiting the pivoting of the first and second support levers of the at least two support levers when the second storage element is displaced to the lifted access position.

* * * * *